US006235388B1

(12) United States Patent
Yamamoto et al.

(10) Patent No.: US 6,235,388 B1
(45) Date of Patent: May 22, 2001

(54) FIBROUS MATERIALS OF FLUORORESINS AND DEODORANT AND ANTIBACTERIAL FABRICS MADE BY USING THE SAME

(75) Inventors: Katsutoshi Yamamoto; Jun Asano; Toshio Kusumi, all of Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/319,582

(22) PCT Filed: Dec. 9, 1997

(86) PCT No.: PCT/JP97/04514

§ 371 Date: Jun. 9, 1999

§ 102(e) Date: Jun. 9, 1999

(87) PCT Pub. No.: WO98/26115

PCT Pub. Date: Jun. 18, 1998

(30) Foreign Application Priority Data

Dec. 13, 1996 (JP) ..... 8-333828

(51) Int. Cl.[7] ..... D01F 6/00; D01F 6/12

(52) U.S. Cl. ..... 428/364; 428/365; 428/399; 428/421; 428/357

(58) Field of Search ..... 428/421, 357, 428/364, 422, 399, 365, 221

(56) References Cited

U.S. PATENT DOCUMENTS

| | | | | |
|---|---|---|---|---|
| 4,096,227 | * | 6/1978 | Gore | 264/210 |
| 4,166,147 | | 8/1979 | Lange et al. . | |
| 4,440,879 | | 4/1984 | Kawachi et al. . | |
| 4,985,296 | * | 1/1991 | Mortimer, Jr. | 428/220 |
| 5,281,475 | * | 1/1994 | Hollenbaugh, Jr. et al. | 428/357 |
| 5,562,986 | * | 10/1996 | Yamamoto et al. | 428/364 |
| 5,700,572 | * | 12/1997 | Klatt et al. | 428/357 |

FOREIGN PATENT DOCUMENTS

| | | | |
|---|---|---|---|
| 4-176312 | 6/1992 | (JP) | B01D/39/16 |
| 5-195427 | 8/1993 | (JP) | D06M/11/00 |
| 6-248545 | 9/1994 | (JP) | D04H/1/42 |
| 7-500386 | 1/1995 | (JP) | D02G/3/02 |
| 97/31589 | 9/1997 | (WO) . | |

OTHER PUBLICATIONS

"Kogyo Zairou", vol. 44, No. 8, Jul. 1996, pp. 106–109 and partial English translation.
English Translation of International Preliminary Examination Report for PCT/JP97/04514 Report Incomplete.
Abstract of JP 9256217 published Sep. 30, 1997.
Supplementary European Search Report dated Oct. 25, 2000.

* cited by examiner

*Primary Examiner*—N. Edwards
(74) *Attorney, Agent, or Firm*—Sughrue, Mion, Zinn, Macpeak & Seas, PLLC

(57) ABSTRACT

A fibrous material of fluorine-containing resins such as polytetrafluoroethylene which has a high deodorizing antibacterial activity is obtained. A monofilament, staple fiber, split yarn or finished yarn thereof comprising a fluorine-containing resin such as polytetrafluoroethylene containing a photodegrading catalyst such as an anatase-type titanium dioxide in an amount of from 5 to 50% by weight, and a deodorizing antibacterial woven fabric, knitted fabric, and non-woven fabric which are produced by using the monofilament, staple fiber, split yarn or finished yarn thereof.

19 Claims, No Drawings

FIBROUS MATERIALS OF FLUORORESINS AND DEODORANT AND ANTIBACTERIAL FABRICS MADE BY USING THE SAME

TECHNICAL FIELD

The present invention relates to a fibrous material of fluorine-containing resin, particularly polytetrafluoroethylene containing a photodegrading catalyst and a deodorizing antibacterial cloth produced by using the fibrous material.

BACKGROUND ART

A photodegrading catalyst is a substance which is activated by photo energy having a short wave length such as light, particularly ultraviolet ray to exhibit catalytical ability for degrading compounds. Examples of known photodegrading catalyst are anatase-type titanium dioxide ($TiO_2$), zinc oxide (ZnO), tungsten trioxide ($W_2O_3$) and the like. It is known that those photodegrading catalysts degrade compounds emitting malodorous smell and have sterilizing ability, thus being used for deodorizing and for antibacterial purpose. In order for the photodegrading catalysts to exhibit their function effectively, it is necessary to contact the catalysts directly to harmful substances. However if materials carrying the photodegrading catalysts are organic substances, there is a case where the catalysts degrade the materials.

Since fluorine-containing resins represented by polytetrafluoroethylene (PTFE) are materials being free from such degradation, articles in the form of membrane such as sheet and film which comprise PTFE as a matrix resin and contain a photodegrading catalyst have been proposed ("Kogyo Zairyou", July 1996 (Vol. 44, No. 8). However in those forms, a photodegrading catalyst contained in PTFE does not function effectively, and there is a certain limit in its application to interior goods such as curtains.

A main object of the present invention is to provide a fibrous material having excellent deodorizing antibacterial property, by combining a photodegrading catalyst having deodorizing antibacterial activity with a fluorine-containing resin to make a fibrous material, thus enabling the photodegrading catalyst to be exposed more on the surface of the fibrous material, and to provide a cloth produced by using the fibrous material.

DISCLOSURE OF THE INVENTION

Namely the present invention relates to a fibrous material comprising a fluorine-containing resin having a photodegrading catalyst.

A preferred photodegrading catalyst is an anatase-type titanium dioxide. It is preferable that the catalyst is contained in or adhered to the fibrous material in an amount of from 1 to 50% (% by weight, hereinafter the same). It is particularly preferable that the catalyst is contained therein. Adhering can be carried out by coating, impregnating or the like. There is a case where PTFE is preferably a semi-sintered one. PTFE may contain an adsorbent having deodorizing activity. The adsorbent may be contained in a coating of the fibrous material.

The fibrous material is preferably in the forms mentioned below.

(1) Monofilament
(2) Staple fiber
(3) Continuous yarn split to the net-like form
(4) Finished yarn produced by mix-spinning or mix-twisting at least one of other fibrous materials to above (1) to (3)

Among them, the monofilament and staple fiber may have branches.

The other fibrous material used for the finished yarn is preferably an activated carbon fiber, and may contain the adsorbent or may be coated with the adsorbent.

Also the present invention relates to the deodorizing antibacterial cloth made of the fibrous material.

The deodorizing antibacterial cloth may comprise a non-woven fabric, woven fabric or knitted fabric made by combining at least one of the other fibrous materials. At least one of the other fibrous material may be an activated carbon fiber or a material containing the activated carbon fiber, or may be a material containing the adsorbent or coated with the adsorbent.

Further the deodorizing antibacterial cloth may be combined with a base fabric such as a non-woven fabric, woven fabric or knitted fabric made of other fibrous material to give a composite cloth. In that case, the base fabric may contain an activated carbon fiber or may contain the adsorbent or be coated with the adsorbent.

BEST MODE FOR CARRYING OUT THE INVENTION

The fibrous material of the present invention basically comprises the fluorine-containing resin having the photodegrading catalyst. Examples of the fluorine-containing resin are PTFE, PFA, FEP, ETFE and the like. Among them, PTFE is preferred. The following explanation is made based on PTFE, but is also applicable to other fluorine-containing resins.

PTFE used in the present invention encompasses homopolymer of tetrafluoroethylene (TFE) and a copolymer of TFE and other comonomer of at most 0.2%. Non-restricted examples of the comonomer are, for instance, chlorotrifluoroethylene, hexafluoropropylene, perfluoro (alkyl vinyl ether) and the like. Polymerization may be carried out by either of emulsion polymerization and suspension polymerization.

Examples of the photodegrading catalyst are anatase-type titanium dioxide, zinc oxide, tungsten trioxide and the like. The catalyst is usually in the form of powder. Among the photodegrading catalysts, anatase-type titanium dioxide is particularly preferable from the points that various malodorous substances such as ammonia, acetaldehyde, acetic acid, trimethylamine, methylmercaptan, hydrogen sulfide, styrene, methyl sulfide, dimethyl disulfide, isovaleric acid and the like can be degraded and that the degrading effect is exhibited even by weak light (ultraviolet ray).

A content of the photodegrading catalyst is preferably not less than 5% by weight from the viewpoint of rapid exhibition of deodorizing antibacterial activity and not more than 50% by weight from the viewpoint of easy molding, particularly from 10 to 40% by weight.

In the present invention, the "fibrous material" is a concept encompassing the above-mentioned monofilament, staple fiber, split yarn, finished yarn and the like.

Examples of methods for producing those PTFE fibrous materials having the photodegrading catalyst are as follows.

(1) Production of monofilament (A) Production by emulsion spinning method (cf. U.S. Pat. No. 2,772,444)

An aqueous dispersion of PTFE fine powder, photodegrading catalyst powder, surfactant and coagulant (usable coagulant coagulated under acidic condition, for example, sodium alginate) is extruded through fine nozzles in an acidic bath, and a coagulated extrudate in the form of fiber is dried, sintered and stretched to give a monofilament.

(B) Production by opening a film (cf. WO94/23098)

(a) Production of PTFE powder containing titanium dioxide

An aqueous dispersion of: PTFE prepared by emulsion polymerization and an aqueous dispersion of the photodegrading catalyst powder are mixed, followed by stirring or adding an agglomerating agent (adding dropwise hydrochloric acid, nitric acid or the like) and then sting to agglomerate primary particles of PTFE and at the same time to coagulate the photodegrading catalyst powder therewith, thus giving secondary particles (average particle size: 200 to 1000 $\mu$m) obtained by incorporating the photodegrading catalyst powder into the agglomerated primary particles of PTFE. Then the secondary particles are dried to remove water and give a powder (a-1).

Another method is a method (a-2) for uniformly mixing a PTFE molding powder prepared by suspension polymerization and a photodegrading catalyst powder.

In the methods (a) for producing PTFE powder containing the photodegrading catalyst, the method (a-1) is preferable. In the method (a-1) it is possible that a larger amount of photodegrading catalyst powder is introduced (for example, 10.1 to 40% by weight), and a uniform molded article can be produced from the obtained powder. Also when a fibrous material is produced finally, the photodegrading catalyst powder is uniformly dispersed therein and excellent photocatalytical activity can be obtained. According to that method, the photodegrading catalyst powder can be contained uniformly in a large amount (for example, more than 30%).

(b) Production of un-sintered film

An auxiliary solvent for extrusion molding (for example, Isopar M which is a petroleum solvent available from Exxon Chemical Co., Ltd.) is added to the mixed powder obtained in above (a), followed by paste extrusion and calender molding to give a film. Then the auxiliary solvent for extrusion molding is dried to give an un-sintered film.

(c) Production of heat-treated film (Sintered film A, Semi-sintered film B)

Sintered film A can be obtained by heating the un-sintered film produced in the above (b) in an atmosphere of not less than a melting point of PTFE powder, usually from 350° to 380° C. for about two minutes or longer.

Also a sintered film can be obtained by compression-molding the mixed powder obtained in the above (a-2) to give a cylindrical pre-form and then heating the pre-form at 360° C. for 15 hours, cooling and cutting.

Semi-sintered film B can be obtained by heat-treating the un-sintered film of the above (b) at a temperature between the melting point (about 345° to 348° C.) of an un-sintered powder and the melting point (325° to 328° C.) of a sintered article.

The film can also be produced by a method of coating a dispersion of a mixture of fluorine-containing resin particles and titanium dioxide particles on a fluorine-containing resin film and then sintering, or a method of coating the dispersion on a plate of aluminum or the like or on a polyimide film and then sintering to give a cast film.

In that case, the fluorine-containing resin particles or film may comprise PTFE solely or a mixture with PFA and FEP, or may be a composite film.

(d) Production of stretched film (C and D)

A stretched film (Stretched film C) can be obtained by passing Sintered film A between the rolls in the longitudinal direction with heating and stretching at a stretching ratio of about 5 times by changing a relative speed of the rolls, or a stretched film (Stretched film D) can be obtained by passing Semi-sintered film B between the rolls in the longitudinal direction with heating and stretching at a stretching ratio of about 5 to 20 times by changing a relative speed of the rolls.

(e) Production of monofilament

A monofilament can be obtained by a method of cutting Sintered film A or Semi-sintered film B into thin strips and then stretching in the longitudinal direction.

The monofilament having branches can be obtained by another method of tearing Stretched film C or D with rotating needle blade rolls, and also by a method of tearing and then dividing.

A maximum thickness of the monofilament is determined depending on a starting film. A minimum thickness of the monofilament is determined by a minimum slit width, and is about 25 tex.

(2) Production of staple fiber (cf. WO94/23098)

A staple fiber can be produced by cutting the above-mentioned monofilament to an optional length (Preferable length is from about 25 mm to about 150 mm). Also it is preferable to let the staple fiber have branches in order to enhance entangling property of the fiber and increase a surface area with more fine fibers. A staple fiber having branches can be obtained by tearing Stretched film C or D with needle blade rolls rotating at high speed.

The staple fiber has branches and crimps and can be used alone as it is or in the form of finished yarn mentioned below.

Particulars of the staple fiber obtained by the above-mentioned method are preferably as follows, but are not restricted to them.

Fiber length: 5 to 200 mm, preferably 10 to 150 mm

Number of branches: 0 to 20/5 cm, preferably 0 to 10/5 cm

Number of crimps: 0 to 25/20 mm, preferably 1 to 15/20 mm

Fineness: 1 to 150 deniers, preferably 2 to 75 deniers

Sectional configuration: Irregular (3) Production of split yarn (cf. WO95/00807)

A split yarn can be produced by slitting uniaxially Stretched film C or D produced in the above (d) of (1)-(B) into a ribbon form of about 5 mm to about 20 mm width and then splitting with a needle blade roll, preferably a pair of needle blade rolls.

A network structure is a structure in which the uniaxially stretched PTFE film is not split into pieces of fibers with needle blades of needle blade rolls but the split film has a net-like form when extended in the widthwise direction (in the direction crossing at a right angle to the film feeding direction).

The split yarn can be used alone as it is or in a bundled form of two or more thereof or in the form of finished yarn mentioned below for knitting and weaving.

(4) Production of finished yarn

A finished yarn can be produced by combining the PTFE fibrous material having a photodegrading catalyst and obtained in the above (1), (2) or (3) with other fibrous material.

Mix-spinning and mix-twisting can be carried out by usual methods.

Examples of the other fibrous material are an activated carbon fiber; natural fibrous materials such as cotton and wool; semi-synthetic fiber such as rayon; synthetic fibrous materials such as polyester, nylon and polypropylene; and the like. In case where strong odor increases rapidly (increase in gas concentration), an activated carbon fiber or the like is preferable as the other fibrous material for a deodorizing antibacterial cloth. Examples of the activated carbon fiber are one obtained, for example, from an acrylic fiber, and the like. It is preferable that an amount of the PTFE fibrous material having the photodegrading catalyst is not less than 10%, particularly not less than 20% of the finished yarn from the viewpoint of exhibiting deodorizing antibacterial activity.

It is preferable to let an adsorbent having deodorizing activity exist in various forms in the PTFE fibrous material having the photodegrading catalyst of the present invention in order to enhance deodorizing efficiency. Examples of the adsorbent having deodorizing activity are fibers or particles of an activated carbon, zeolite, Astench C-150 (available from Daiwa Chemical Co., Ltd.) and the like.

An amount of the activated carbon particles or zeolite particles among the mentioned adsorbents, when they are contained in the form of filler in PTFE, is not more than 25%, preferably 1 to 20% based on PTFE.

Astench C-150 can be applied by coating or impregnating in the other fibrous material which is used in the finished yarn or in production of a cloth (mentioned below). It is preferable that coating or impregnating of Astench C-150 is carried out by coating through usual method such as dipping or spraying by using about 10% aqueous solution of Astench C-150, and then dehydrating and drying.

As mentioned above, the activated carbon fiber having a deodorizing activity can be used as one of other fibrous materials for the finished yarn. In that case, it is preferable that an amount of the activated carbon fiber is not more than 80%, particularly from 5 to 75% of the finished yarn.

The PTFE fibrous material having the photodegrading catalyst of the present invention is applied to effectively exhibit deodorizing and antibacterial activity by its photodegrading function, is in the form of woven fabric, knitted fabric and non-woven fabric and is useful, for example, as a deodorizing antibacterial cloth.

The present invention further relates to the deodorizing antibacterial cloth comprising the above-mentioned PTFE fibrous material having the photodegrading catalyst.

The cloth of the present invention encompasses a woven fabric, knitted fabric and non-woven fabric and can be produced by usual method.

The deodorizing antibacterial cloth of the present invention may be in the form of multi-layered cloth produced in combination with a base fabric comprising other fibrous material. The base fabric to be used may be in any form of woven fabric, non-woven fabric and knitted fabric. Examples of preferred material of the base fabric are an activated carbon fiber, meta-linked type aramid fiber, para-linked type aramid fiber, PTFE fiber, polyimide fiber, glass fiber, polyphenylene sulfide fiber, polyester fiber and the like. It is particularly preferable that the base fabric contains an activated carbon fiber, to enhance a deodorizing effect. A content of the activated carbon fiber in the base fabric is from about 5% to about 100%, preferably from about 10% to about 100%.

The thus produced fluorine-containing resin fibrous material of the present invention is used as it is or processed to desired form, as a filler for various materials or for applications such as carpet, illumination cover, reflection plate, interior cloth, blind, curtain, roll curtain, bedclothes (bed cover, pillow cover, etc.), shoji screen, wall cloth, tatami mat, window screen, air filter, filter for air conditioning, liquid filter, interior materials for vehicles (car, train, airplane, ship, etc.), net lace, clothes for medical use (operating gown, etc.), gloves for medical use (surgery gloves, etc.), curtain for bath room, paper diaper, slippers, shoes (school shoes, nurse shoes, etc.), telephone cover, sterilizing filter for 24-hour bath, foliage plant (artificial flower), fishing net, clothes, socks, bag filter, and the like. Particularly the deodorizing antibacterial cloth can be used for diaper cover, clothes such as apron, bedclothes such as bed, mat, pillow and sheet clothes, decorative materials such as curtain, table cloth, mat and wall cloth, and the like. Further the cloth is useful for applications in places where malodorous smelling and propagation of bacteria are apt to arise, such as hospital, toilet, kitchen, dressing room, and the like.

Then the fibrous material and deodorizing antibacterial cloth of the present invention are explained based on examples, but the present invention is not limited to them.

EXAMPLE 1

(1) Production of PTFE powder containing titanium dioxide

A 10% aqueous dispersion containing 8 kg of PTFE particles obtained by emulsion polymerization (number average molecular weight: 5,000,000, average particle size: about 0.3 $\mu$m) and a 20% aqueous dispersion containing 2 kg of anatase-type titanium dioxide (Titanium Dioxide P25 available from Nippon Aerosil Co., Ltd., average particle size: about 21 $\mu$m) were poured continuously into a coagulation tank (capacity: 150 liters, inside temperature of the tank: 30° C.) equipped with stirring blades and a jacket for adjusting temperature and then stirred to give uniformly co-agglomerated secondary particles of PTFE particles and titanium dioxide particles, followed by separating the co-agglomerated particles from water phase. Those co-agglomerated particles were dried in an oven (130° C.) to give a PTFE powder (average particle size: 500 $\mu$m, apparent density: about 450 g/liter) containing titanium dioxide in an amount of 20%.

(2) Production of un-sintered film

To the PTFE powder containing titanium dioxide and obtained in the above (1) was mixed 25 parts of an extrusion molding auxiliary (petroleum solvent Isopar M available from Exxon Chemical Co., Ltd.) based on 100 parts of the powder to give a mixture in the form of paste. The paste was extruded by paste extrusion method, and rolled with rollers, followed by drying to remove the molding auxiliary. Thus a continuous un-sintered PTFE film containing titanium dioxide and having a width of 200 mm and a thickness of 100 $\mu$m was produced.

(3) Production of heat-treated film

The un-sintered PTFE film containing titanium dioxide which was produced in the above (2) was heat-treated to give Sintered PTFE film A-1 containing titanium dioxide and Semi-sintered PTFE film B-1 containing titanium dioxide.

Sintered PTFE film A-1 was obtained by heating the un-sintered PTFE film at 360° C. for about three minutes in an oven.

Semi-sintered PTFE film B-1 was obtained by heating the un-sintered PTFE film for about 30 seconds in an oven of 340° C. A degree of sintering (crystalline conversion ratio) of the film B-1 was 0.4.

(4) Production of uniaxially stretched film

Sintered PTFE film A-1 was stretched 5 times in the longitudinal direction between two pairs of heating rolls (diameter: 330 mm, temperature: 300° C.) to give Uniaxially stretched film C-1.

Also Semi-sintered PTFE film B-1 was stretched 10 times in the longitudinal direction with the above-mentioned heating rolls to give Uniaxially stretched film D-1.

The uniaxially stretched films can be used as they are since the titanium dioxide particles are exposed more on the surface of the films as compared with an un-stretched film. Further as mentioned below, by forming the films into a fiber, more preferable characteristics and applications can be provided.

(5) Production of monofilament

Sintered PTFE film A-1 or Semi-sintered PTFE film B-1 of the above (3), after having been slit to 2 mm width, was uniaxially stretched in the same manner as the above (4). Thus a monofilament of 200 tex having a rectangular section was obtained from the film A-1 and a monofilament of 100 tex having a rectangular section was obtained from the film B-1.

In addition to the method of (6) mentioned below, a staple fiber can be produced by a method of cutting those monofilaments into short pieces.

(6) Production of staple fiber

Uniaxially stretched film C-1 or D-1 obtained in the above (4) was torn and opened according to the method of (4) of Example 5 disclosed in WO94/23098 by using a pair of upper and lower needle blade rolls at a film feeding speed (V3) of 1.6 m/min and a peripheral speed (V4) of needle blade rolls of 48 m/min to give a staple fiber. The obtained staple fiber comprised filaments, and each filament had branches.

The sintered staple fiber obtained from Uniaxially stretched sintered PTFE film C-1 and the semi-sintered staple fiber obtained from Uniaxially stretched semi-sintered PTFE film D-1 are assumed to be E-1 and F-1, respectively.

With respect to the obtained PTFE staple fiber containing titanium dioxide, a fiber length, the number of branches, sectional configuration, fineness and the number of crimps were determined by the following methods. The results are shown in Table 1.

(Fiber length and number of branches)

With respect to a hundred pieces of fibers sampled at random, the length and the number of branches (including loops) were measured.

(Sectional configuration)

Sectional configuration of a bundle of fibers sampled at random was determined by using a scanning electron microscope.

(Fineness)

Fineness of a hundred pieces of fibers sampled at random was measured with an electronic fineness measuring apparatus (available from Search Co., Ltd.) by utilizing a resonance of the fiber.

The apparatus could measure the fineness of the fibers having the length of not less than 3 cm, and the fibers were selected irrespective of trunks or branches. But the fibers having, on the length of 3 cm, a large branch or many branches were excluded because they affects the measuring results. The apparatus was capable of measuring the fineness in the range of 2 to 70 deniers, and so the fineness exceeding 70 deniers was determined by measuring the weight of the fiber. The fibers having the fineness less than 2 deniers were excluded because measurement was difficult.

(Number of crimps)

Measurement was made in accordance with the method of JIS L 1015 by means of an automatic crimp tester available from Kabushiki Kaisha Koa Shokai with a hundred pieces of fibers sampled at random (The crimps on the branch were not measured).

TABLE 1

| Particulars | Staple fiber | |
|---|---|---|
| | Sintered fiber | Semi-sintered fiber |
| Fiber length (mm) | 11 to 105 | 9 to 93 |
| Number of branches (per 5 cm) | 0 to 7 | 0 to 5 |
| Sectional configuration | Irregular | Irregular |
| Fineness (denier) | 2 to 53 | 2 to 42 |
| Number of crimps (per 20 mm) | 0 to 4 | 0 to 5 |

(7) Production of split yarn (cf. WO96/00807)

Uniaxially stretched sintered PTFE film C-1 was cut to 5 mm width in the longitudinal direction, and the cut film was passed through two pairs of needle blade rolls provided with needle blades thereon and rotating at high speed (peripheral speed of blade: 30 m/min) at a film feeding speed of 5 m/min to give a split yarn of 500 tex (500 g per 1 km) having a network structure.

(8) Production of finished yarn

Opening, mix-spinning, carding and twisting were carried out by usual method by using the same amount of Sintered staple fiber E-1 and raw wool to give a finished yarn of 200 tex (200 g per 1 km)

EXAMPLE 2

(Production of deodorizing antibacterial non-woven fabric)

A web was produced from Sintered PTFE staple fiber E-1 containing titanium dioxide. The web was placed on a base fabric of meta-linked type aramid fiber (Product No. CO1700 available from Teijin Ltd.) so that a weight per unit area became 200 g/m$^2$ (Sample A) and 40 g/m$^2$ (Sample B) and then needle-punched to give a non-woven fabric. The number of needles was 100 needles/cm$^2$.

Also a web was produced from Semi-sintered PTFE staple fiber F-1 containing titanium dioxide. The web was placed on a meta-linked type aramid fiber felt (Product No. GX-0302 available from Nippon Felt Kogyo Kabushiki Kaisha, weight per unit area: 350 g/m$^2$) so that a weight per unit area became 200 g/m$^2$ (Sample C) and 40 g/m$^2$ (Sample D) and then subjected to water jet entangling to give a multi-layered non-woven fabric.

With respect to the obtained deodorizing antibacterial non-woven fabric (Samples A to D), the following deodorization tests were carried out. The results (rate constant k of degradation) are shown in Table 2.

(Deodorization tests)

A sample (9 cm×9 cm) is placed in a 5-liter flask (having gas inlet and outlet), and a light source (one 6 W black light) is arranged 2 cm apart from the sample in parallel therewith. Then acetaldehyde is introduced into the flask and a concentration of acetaldehyde is measured with a lapse of time to determine a degradation rate of acetaldehyde. Acetaldehyde is initially introduced with a syringe so that its initial concentration is about 20 ppm. A change in concentration with a lapse of time is measured at intervals of one minute with a gas monitor (multi-gas monitor of model 1302 available from B & K Corp).

The concentration C after a lapse of t minute is represented by the following equation.

$$C=C_0e-kt$$

in which $C_o$ is an initial concentration, e is a natural logarithm and k is a rate constant of degradation. The larger the value k (ppm/sec) is, the higher the degrading activity for acetaldehyde is.

For comparison, the following Films A to D were produced, and the same deodorization tests were carried out. The results are shown in Table 2.

Film A: Uniaxially stretched (5 times) sintered PTFE film containing 20% of titanium dioxide (weight: 200 g/m$^2$)

Film B: Uniaxially stretched (5 times) sintered PTFE film containing 20% of titanium dioxide (weight: 40 g/m$^2$)

Film C: Uniaxially stretched (10 times) semi-sintered PTFE film containing 20% of titanium dioxide (weight: 200 g/m$^2$)

Film D: Uniaxially stretched (10 times) semi-sintered PTFE film containing 20% of titanium dioxide (weight: 40 g/m$^2$)

TABLE 2

| Articles tested | Weight per unit area (g/m$^2$) | Rate Constant k of Degradation ($\times 10^{-5}$) |
|---|---|---|
| Sintered PTFE | | |
| Sample A | 200 | 153 |
| Film A | 200 | 3.82 |
| Sample B | 40 | 96.1 |
| Film B | 40 | 43.6 |
| Semi-sintered PTFE | | |
| Sample C | 200 | 201 |
| Film C | 200 | 5.28 |
| Sample D | 40 | 121 |
| Film D | 40 | 63.5 |

As is clear from Table 2, the degradation rate of acetaldehyde is increased greatly when the non-woven fabrics are produced from the fibrous material of PTFE containing titanium dioxide. Thereby it is recognized that an excellent deodorizing effect is exhibited.

EXAMPLE 3

(Production of deodorizing antibacterial non-woven fabric)

A web was obtained from the Sintered PTFE staple fiber E-1 containing titanium dioxide, and placed on a felt of activated carbon fiber (Kuractive available from Kuraray Co., Ltd., weight per unit area: 150 g/m$^2$) so that a unit weight became 100 g/cm$^2$. Then needle punching was carried out with 100 needles/cm$^2$ to give a multi-layered non-woven fabric.

Deodorization tests were carried out in the same manner as in Example 2 by using the obtained non-woven fabric. Two minutes after starting emission of light, the concentration of acetaldehyde decreased to a half. Due to the remarkable decrease in the concentration, the rate constant k of degradation could not be determined.

EXAMPLE 4

(Production of deodorizing antibacterial woven fabric)

A plain-woven fabric (400 g/m$^2$) was produced by using the sintered PTFE split yarn containing titanium dioxide which was obtained in the above (7), as a weft and a polyester fiber finished yarn of 20 tex (20 g per 1 km) as a warp.

Deodorization tests were carried out in the same manner as in Example 2 by using the obtained woven fabric. The rate constant k of degradation was $171\times10^{-5}$.

EXAMPLE 5

(Production of deodorizing antibacterial woven fabric)

A twill-woven fabric (500 g/m$^2$) having two wefts was produced by using the finished yarn of sintered PTFE containing titanium dioxide which was obtained in the above (8).

Deodorization tests were carried out in the same manner as in Example 2 by using the obtained woven fabric. The rate constant k of degradation was $135\times10^{-5}$.

REFERENCE EXAMPLE

Comparison between a co-agglomerated powder and a dry blend powder

[Preparation of co-agglomerated powder]

A 50-liter stirring tank was charged with an aqueous dispersion of PTFE particles (average particle size: 0.3 $\mu$m, number average molecular weight: 5,000,000, concentration: 10% by weight, equivalent to 4 kg of PTFE) obtained by emulsion polymerization of TFE and an aqueous dispersion of titanium dioxide particles (titanium dioxide P-25 available from Nippon Aerosil Co., Ltd., concentration: 10% by weight, equivalent to 1 kg of titanium dioxide), followed by mixing and stirring to give a co-agglomerated product of PTFE and titanium dioxide. The co-agglomerated product was then dried in a drying oven of 150° C. The obtained powder was assumed to be "Powder ①" (titanium dioxide content: 20% by weight, average particle size of the powder: 440 $\mu$m, apparent density of the powder: 0.45).

[Preparation of dry blend powder]

In the same manner as mentioned above, a 50-liter stirring tank was charged with an aqueous dispersion of PTFE particles (average particle size: 0.3 $\mu$m, number average molecular weight: 5,000,000, concentration: 10% by weight, equivalent to 5 kg of PTFE) obtained by emulsion polymerization of TFE, followed by mixing and stirring to give an agglomerated product of PTFE. The agglomerated product was then dried in a drying oven of 150° C. (average particle size of the powder: 450 $\mu$m, apparent density of the powder: 0.45).

Subsequently the PTFE powder and titanium dioxide powder were mixed by shaking in a 2-liter wide neck polyethylene bottle to give a powder mixture of 500 g. A powder mixture obtained by blending titanium dioxide in an amount of 5% by weight based on the PTFE powder is assumed to be "Powder ②" and a powder mixture obtained by blending titanium dioxide in an amount of 20% by weight based on the PTFE powder is assumed to be "Powder ③".

[Mixing of molding auxiliary]

Powder ① was put in a 2-liter wide neck polyethylene bottle, and then 25 parts by weight of the molding auxiliary Isopar M (petroleum solvent available from Exxon Chemical Co., Ltd.) was added thereto, the same procedures being conducted to each of Powder ② and ③.

[Results of molding of each powder]

Each powder mentioned above was evaluated with respect to moldability by paste extrusion (appearance of extrudate) with a die mold having a cylinder diameter of 50 mm and a die diameter of 6 mm; calendering property of the extrudate by calender rolls (appearance in case of making a thickness to 100 $\mu$m); stretchability of the sintered rolled film (sintering temperature: 370° C.) (whether or not the film can be stretched 5 times under the conditions of the film width of 20 mm, chuck tube of 50 mm and stretching temperature of 300° C.); and a state of distribution of titanium dioxide on the film (samples were collected at random from five points of the film and scanned with a X-ray micro analyzer having a magnification of 50 times that of an electron microscope). The results are shown in Table 3. From the results shown in Table 3, it is seen that the co-agglomerated product is superior.

TABLE 3

| | Powder ① | Powder ② | Powder ③ |
|---|---|---|---|
| Moldability by paste extrusion | Normal Extrudate had linearity | Abnormal Meandering of extrudate occurred | Abnormal Cracking occurred in places of a surface of extrudate |
| Calendering property | Normal Stable long film | Abnormal Unstable film width | Abnormal Sometimes film being cut |
| Stretchability | Normal Stretched stably | Abnormal 2 To 3 pieces of 10 samples were broken in average | Abnormal All samples were broken during stretching |
| Distribution of titanium dioxide | Uniform | Slightly non-uniform | Significantly non-uniform |

What is claimed is:

1. A fibrous material comprising polytetrafluoroethylene having a photodegrading catalyst, wherein the photodegrading catalyst is contained in an amount of 1 to 50% by weight, the photodegrading catalyst comprises anatase-titanium dioxide, and the polytetrafluoroethylene is a semi-sintered polytetrafluoroethylene.

2. The fibrous material of claim 1, wherein further an adsorbent having deodorizing activity is contained.

3. The fibrous material of claim 1, wherein fibrous material is coated with an adsorbent having deodorizing activity.

4. The fibrous material of claim 1, wherein the fibrous material is in the form of monofilament.

5. The fibrous material of claim 1, wherein the fibrous material is in the form of staple fiber.

6. The fibrous material of claim 1, wherein the fibrous material has a branch.

7. The fibrous material of claim 1, wherein the fibrous material is a continuous yarn which is split to a net-like form.

8. The fibrous material of claim 1, wherein the fibrous material is a finished yarn produced by mix-spinning or mix-twisting with at least one of other fibrous materials.

9. The fibrous material of claim 8, wherein at least one of said other fibrous materials is an activated carbon fiber.

10. The fibrous material of claim 8, wherein at least one of said other fibrous materials contains an adsorbent having deodorizing activity, or is coated with the adsorbent.

11. A deodorizing antibacterial cloth comprising the fibrous material of claim 8.

12. A deodorizing antibacterial cloth comprising a non-woven fabric, woven fabric or knitted fabric produced by combining the fibrous material of claim 8 with at least one of other fibrous materials.

13. The deodorizing antibacterial cloth of claim 12, wherein at least one of said other fibrous materials contains an activated carbon fiber.

14. The deodorizing antibacterial cloth of claim 12, wherein at least one of said other fibrous materials contains an adsorbent having deodorizing activity, or is coated with the adsorbent.

15. A multi-layered deodorizing antibacterial cloth produced by combining the deodorizing antibacterial cloth of claim 1 with a base fabric of a non-woven fabric, woven fabric or knitted fabric comprising other fibrous material.

16. The multi-layered deodorizing antibacterial cloth of claim 15, wherein a part of or a whole of other fibrous material of said base fabric contains an adsorbent having deodorizing activity, or is coated with the adsorbent.

17. The multi-layered deodorizing antibacterial cloth of claim 15, wherein other fibrous material of said base fabric is an activated carbon fiber.

18. The fibrous material of claim 1, wherein the fibrous material is obtained from a powder comprising PTFE secondary particles containing the photodegrading catalyst which are prepared by co-agglomerating in coexistence of the photodegrading catalyst at the time of agglomeration of PTFE primary particles in an aqueous dispersion.

19. A multi-layered deodorizing antibacterial cloth produced by combining the deodorizing antibacterial cloth of claim 12 with a base fabric of a non-woven fabric, woven fabric or knitted fabric comprising other fibrous material.

* * * * *